United States Patent [19]

Fallot

[11] 3,980,374

[45] Sept. 14, 1976

[54] SEPARABLE SPLICE CONNECTOR

[75] Inventor: Alan Clyde Fallot, Spring Lake, Mich.

[73] Assignee: International Telephone and Telegraph Corporation, New York, N.Y.

[22] Filed: Feb. 26, 1975

[21] Appl. No.: 553,099

[52] U.S. Cl. ..... 339/60 C; 174/72 R; 339/92 R

[51] Int. Cl.[2] ..... H01R 11/10

[58] Field of Search ..... 339/59 R, 60 R, 60 C, 339/61 R, 92 R; 174/72 R

[56] References Cited

UNITED STATES PATENTS

| | | | |
|---|---|---|---|
| 3,585,568 | 6/1971 | Hervig | 339/60 R |
| 3,656,084 | 4/1972 | Malia | 339/60 R |
| 3,697,932 | 10/1972 | Keto | 174/72 R |

*Primary Examiner*—Roy Lake
*Assistant Examiner*—Mark S. Bicks
*Attorney, Agent, or Firm*—James B. Raden; William J. Michals

[57] ABSTRACT

A separable splice connector which is particularly suitable for 15/25 kV, 600 ampere primary distribution system cables is disclosed. The connector includes a unitary splice body assembly of molded elastomeric material having a longitudinal portion for receiving lug conductor terminated adjacent cable ends thereon, and a transverse portion for receiving removable threaded fastening means which function to secure the lug conductors together within the splice body. The fastening means also provides interface or adapter means for external interchangeable components. Accordingly, the connector provides a separable straight splice of the cables and standard 600 ampere interfaces for transformer bushings, connector plugs, test point plugs, reducing plugs, and the like.

5 Claims, 5 Drawing Figures

SEPARABLE SPLICE CONNECTOR

BACKGROUND OF THE INVENTION

This invention relates to separable splice connectors and, more particularly, a unitary splice connector which facilitates attachment to related devices.

Splice connectors for primary distribution system power lines are known and have been widely used in the art. One such splice connector utilizes two separate "elbows" each of which actually take the form of a "T". The cable ends are respectively received in the main legs of the elbows and the cross legs of the elbows are rigidly joined by means of a connector plug. The free ends of the elbows accommodate adapters for external utilization devices such as loadbreak elbows or voltage test point plugs. A prominent disadvantage of this type of prior art splice connector is that since the cable ends are secured to the joined portions of the elbow connectors in a perpendicular configuration, the overall size of the assembled connector is bulky and sometimes unmanageable. Further, numerous parts are required to effect the joining of the cable ends and the individual elbows; and, accordingly, separability is not readily achieved.

Another known connector splice is the Wye splice. As its name implies, this device is utilized to splice three cable ends to a common circuit junction. A generally "Y" shaped bus bar is fastened to the three cable ends such as by bolting. Thereafter, three separate receptacles of the splice housing assembly are forced onto the bus bar while three additional collars are utilized to prevent displacement of the associated cable adapters. While two of the cable ends exhibit straight or in-line configuration, any adapter or third cable coupling is necessarily laterally displaced and, therefore, gives rise to a bulky installation. Further, the third leg is not readily coupled to external utilization devices unless numerous parts are provided to effect such connections. It will also be appreciated that three separate manufacturing operations must be undertaken to provide the separable receptacles.

These and other disadvantages are overcome by the present invention wherein there is provided a unitary splice body which accepts two cable ends in straight or in-line relationship and an interchangeable threaded fastening device secures the splice while simultaneously providing a pair of standard interfaces for external utilization devices.

SUMMARY OF THE INVENTION

Briefly, a separable connector for splicing adjacent cable ends of a primary distribution system line is provided. The connector includes first and second cable adapters each having an insulated portion for surrounding and engaging an insulated portion of the adjacent cable ends and a semiconductive elastomeric portion surrounding and engaging a ground shield portion of the associated cable end. The respective conductor portions of the cable ends extend from the adapters to receive lug conductors thereon. A unitary splice body of molded elastomeric material is provided and includes a generally longitudinal portion for receiving the lug terminated adjacent cable ends, and includes a generally transverse portion in the area where the lugs overlap. The body includes a substantially continuous semiconductive outer jacket, and a semiconductive inner sleeve surrounding the lugs. An insulated portion of the splice body separates the outer jacket and the inner portion and engages the insulated portion of each adapter. First means are provided for removably and rigidly fastening the conductor lugs within the body and providing an electrically conductive circuit junction between the lugs. Second means including the first means are provided and extend through the transverse portion of the body to provide at least one interface for an external utilization device.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
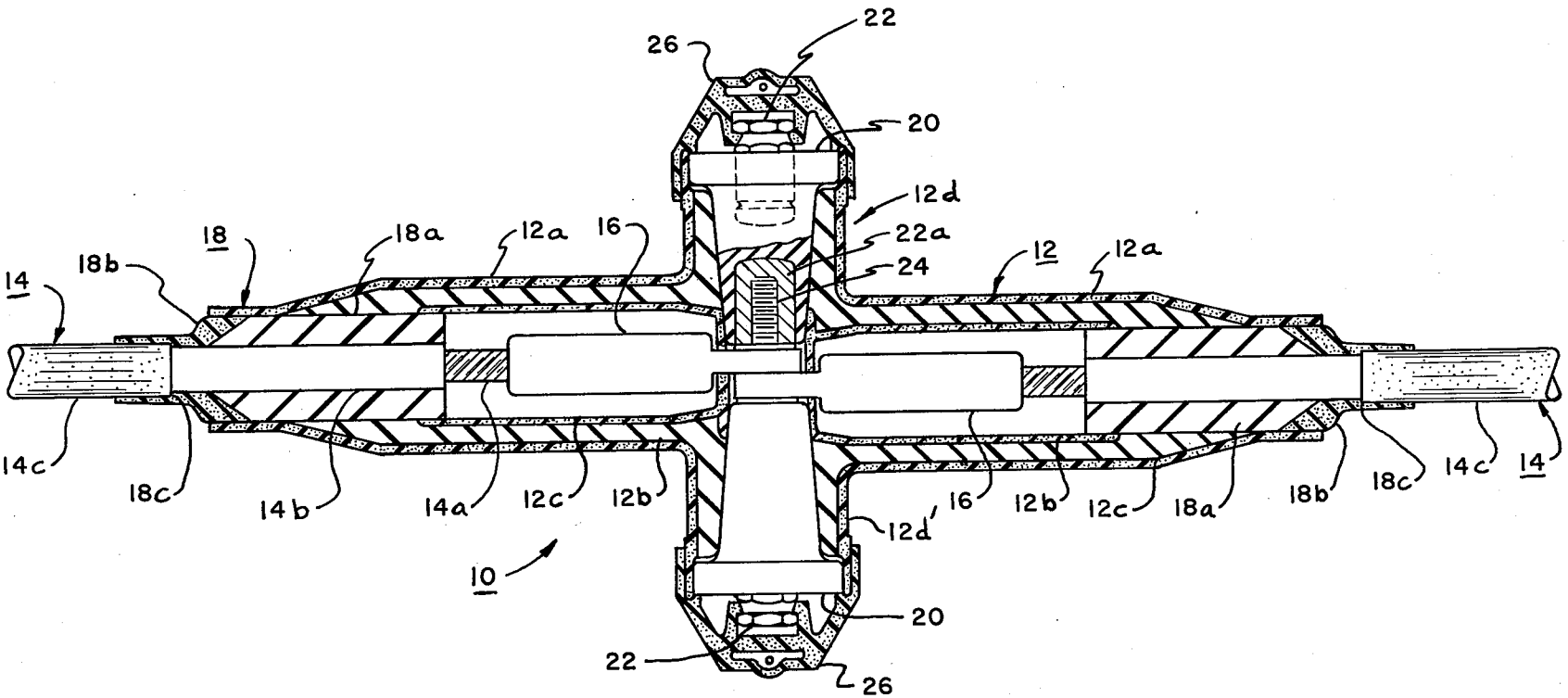
FIG. 1 is a cross-sectional view of a separable splice connector, in accordance with the present invention, in assembly with the adjacent ends of a power distribution line.

Referring now to FIG. 1 there is shown generally at 10 a separable splice connector in accordance with the principles of the present invention. Connector 10 includes a unitary assembly 12 of molded rubber or elastomeric material. Assembly 12 includes a semiconductive outer jacket 12*a*, a semiconductive insert 12*b* and an insulated portion 12*c* which separates the semiconductive portions. Adjacent ends of primary power distribution line 14 each include a cable conductor 14*a* of aluminum or copper or any other suitable conducting material. Coaxially disposed about conductor 14*a* is an insulated portion 14*b* and a conductive ground shield 14*c*. Shield 14*c* may comprise a semiconductive outer jacket of elastomeric material, lead, metallic tape, drain wires or any other suitable material. The exposed conductor 14*a* of each adjacent end is terminated with a lug 16 having an end or tang portion with a bore or eyelet therein.

Prior to attaching lugs 16 each cable end is provided with a cable adapter 18. Adapter 18 includes an insulated portion 18*a* which surrounds and engages insulated portion 18*b* of cable 14. Adapter 18 further includes an end portion 18*b* of semiconductive elastomeric material which surrounds both ground shield 14*c* and insulated portion 14*b* of cable 14. The radially outer portion of member 18*b* engages the semiconductive outer jacket 12*a* of splice body 12. Member 18*b* is provided with a stepped portion 18*c* to prevent longitudinal or backward movement of adapter 18, particularly during installation.

Splice body 12 is also provided with transversely or laterally extending portions 12*d* and 12*d'* which provide an essentially see-through bore therein. In FIG. 1, the transverse portions each receive one of test point plugs 20. The general configuration of plugs 20 is well known in the art. Plugs 20 each generally comprises a fiberglass filled polyester material and includes a hex-headed insert 22 formed of a metallic material and having a fastening stud extending partially into the body of the plug. Each plug includes a metallic insert 22*a* having a threaded bore therein for receiving a conversion stud 24 in threaded engagement therewith. It can be seen that plugs 20 and conversion stud 24 provide a threaded fastener to bolt lugs 16 together and otherwise provide a substantial rigid assembly. This is accomplished by applying wrenches to members 22 to torque the assembly together.

Each test point plug engages a test point cover 26 of a molded semiconductive rubber or elastomeric material. The function of covers 26 is to continue or complete the ground plane provided by jacket 12*a* of assembly 12 and to provide a watertight seal for test point plugs 20. Overall, test point plugs 20 provide a capacitively coupled test point at member 22 for verifying an energized circuit with a high impedance voltmeter as is well-known in the art.

It can be seen that semiconductive insert 12*b* surrounds lug conductors 16 and conductor portions 14*a* and thereby functions as a corona shield to compensate for sharp edges and irregular surfaces on lug connectors 16. By preventing corona, ionized air and insulation deterioration are avoided. The function of insulated portion 12*c* is to prevent circuit failure to ground either through assembly 12 or along the interfaces with adjacent members. Outer jacket 12*a* of assembly 12 functions as ground shielding which continues the ground shield of the cable and protects the operator or installer from leakage currents when the cable is energized. Lug conductors 16 may take the form of aluminum lugs which are hydraulically or mechanically crimped to the conductor portion 14*a* of cable ends 14. Similarly, conversion stud 24 may take the form of a threaded aluminum rod with external threads at both ends for fastening to the internally threaded inserts 22*a* of plugs 20. In practice, two flats are provided at the center portion of stud 24 in order to firmly torque stud 24 into one of the plugs 20 thereby essentially converting a "female" plug to a "male" plug. The resulting male plug is then torqued into the other plug to fasten lug conductors 16 together.

An exemplary procedure for splicing cable ends 14 in accordance with the present invention is as follows. First, the adjacent cable ends are prepared by cutting back a predetermined amount of shield 14*c* and insulated portion 14*b*. Thereafter, cable adapters 18 are driven home onto adjacent cable ends 14 until step 18*c* engages the edge of shield 14*c*. Next, lugs 16 are crimped or otherwise attached to the ends of conductor portions 14*a*. Thereafter, each lug-terminated cable end is inserted into the respective openings of splice body 12 until the tang portion of lugs 16 overlap and the bores or eyelets therein are aligned. Plugs 20 are then inserted and torqued onto stud 24 until the assembly is rigidly secured. Finally, test point covers 26 are snapped over splice body 12 to complete the assembly.

Referring again to FIG. 1, it can be seen that the respective longitudinal axis of the adjacent cable ends are somewhat offset relative to one another. This is done to accommodate the overlapping relationship of the tang portion of lug 16. It should be appreciated however that the offset can be eliminated by providing special lugs with an equivalent offset. However, providing the offset in the housing is preferred as this permits the utilization of existing or off-the-shelf lugs. In currently preferred practice splice body 12 is provided as an integrally molded structure wherein the semiconductor portions are bonded to the insulating portion. It will be appreciated however that inner sleeve 12*b* can be provided as a separable insert. It should also be noted that rather than providing a transverse portion on each side of the lateral portion of splice body 12, a single off-set portion can be provided. That is, if desired a suitable insert can be molded within splice body 12 to accept and threadedly engage but one interface element or component such as test point plug 20. However, such an alternate configuration is not as readily assembled as the preferred device depicted in FIG. 1.

Figure 2:
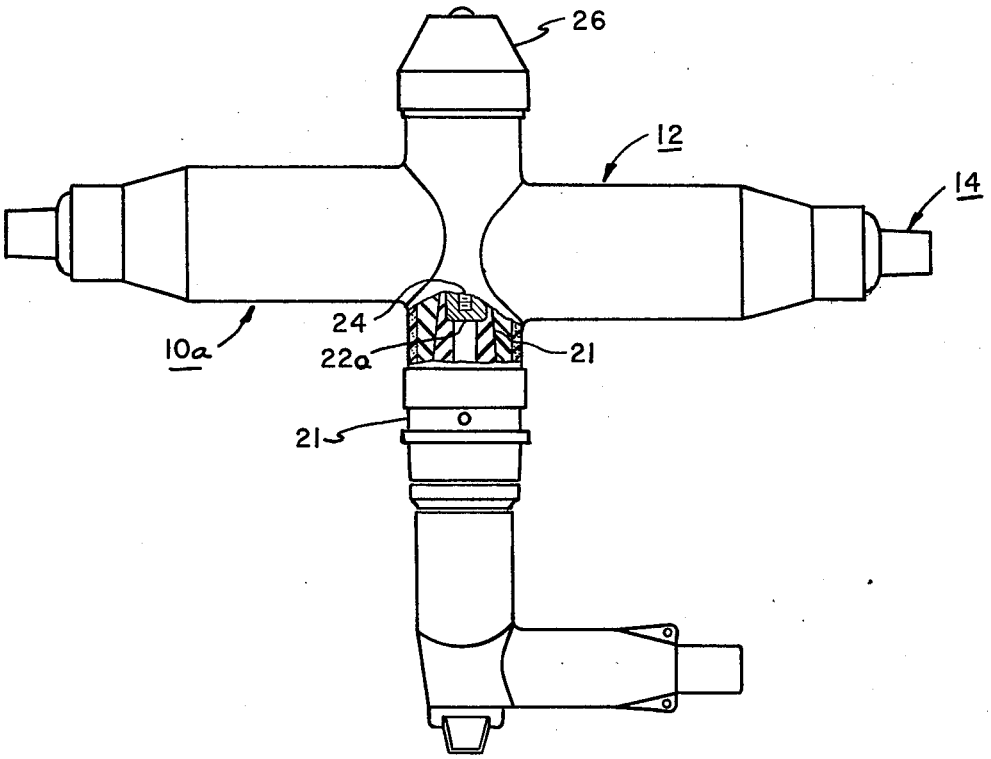
FIG. 2 is a plan view of the separable splice connector in partial cross section as adapted for use with a loadbreak bushing.

Referring now to FIG. 2 there is shown a plan view of the separable splice connector in accordance with the present invention removably attached to a loadbreak bushing. Connector 10*a* of FIG. 2 is similar to connector 10 of FIG. 1 and, accordingly, like elements bear like reference numbers. One of the test point plugs is replaced with a loadbreak bushing adapter 21. However, adapter 21 includes fastening means 22*a* and 24 which are essentially identical to that depicted in FIG. 1. Thus, adapter 21 provides means for tapping a loadbreak bushing to the splice adjacent cable ends.

Figure 3:
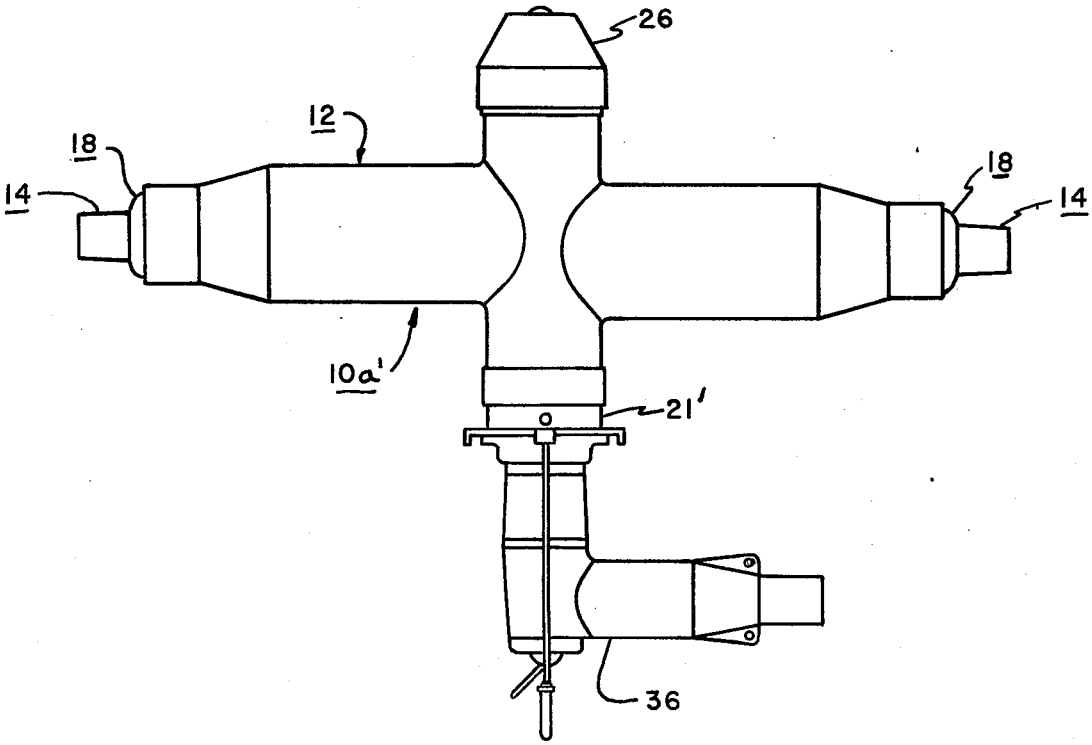
FIG. 3 is a plan view similar to FIG. 2 but showing a similar interface for a deadbreak bushing.

Referring now to FIG. 3, there is shown a separable splice connector 10*a'* removably coupled to a deadbreak elbow 36. Adapter 21' of FIG. 3 is structurally and functionally similar to adapter 21 of FIG. 2 and differs only in the manner in which it mates with elbow 36, as is well known in the art.

Figure 4:
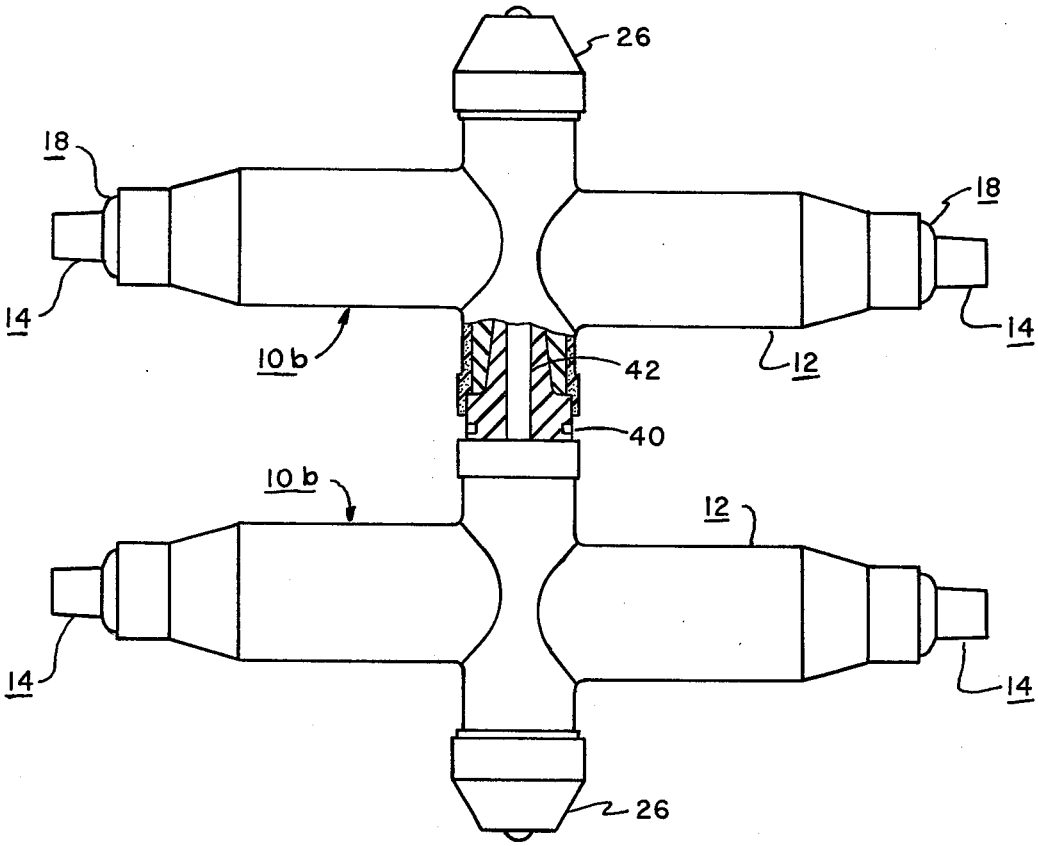
FIG. 4 is a plan view in partial cross section showing the assembly of two separable splice connectors forming a 4-way splice.

Referring now to FIG. 4, there is shown a plan view of two separable splice connectors 10*b*. An adapter 40 is used to secure the cable splice within the respective connectors and to provide a connection between the two splice cables. Adapter 40 includes a metallic member 42 having a female fastening means at a first end and a threaded stud or extension at the opposite end thereon. Adapter 40 takes the form of a connector plug as is well known in the art and, accordingly, may not be described in great detail herein.

Figure 5:
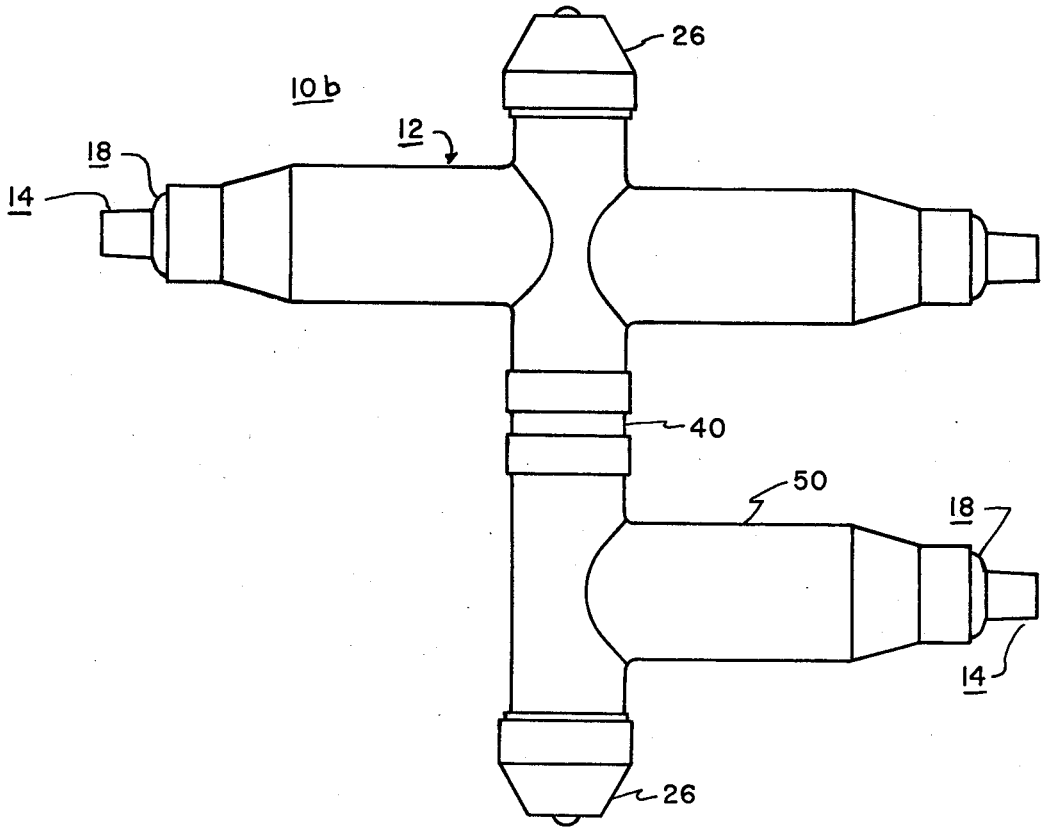
FIG. 5 is a plan view showing the connection of a separable splice connector coupled to a primary distribution system elbow terminator.

Finally, FIG. 5 provides a plan view of a separable splice connector 10*b* coupled to a standard elbow terminator 50 by way of connector plug or adapter 40. Thus, it can be seen that FIG. 5 depicts a 3-way splice whereas FIG. 4 depicts a 4-way splice.

What has been taught, then, is a separable splice connector facilitating, notably, at least one power distribution system cable splice while simultaneously providing at least one interface which is interchangeably attachable to one of a plurality of related system components. The form of the invention illustrated and described herein is a preferred embodiment of these teachings. It is shown as an illustration of the inventive concepts, rather than by way of limitation, and it is pointed out that various alternatives and modifications may be indulged in within the scope of the appended claims.

What is claimed is:

1. A separable connector for splicing adjacent cable ends of a primary distribution system line comprising, in combination:

first and second cable adapters, each adapter having an insulated portion for surrounding and engaging an insulated portion of one of said cable ends and a semi-conductive end portion of said one of said cable ends, and wherein a conductor portion of said one of said cable ends extends from the adapter to receive a lug conductor termination thereon;

a unitary splice body assembly of molded elastomeric material including a generally tubular longitudinal portion for receiving the terminated cable ends from opposite ends thereof and a generally tubular transverse portion at a central portion of said longitudinal portion, wherein said longitudinal portion includes first and second sections respectively extending in opposite directions away from said transverse portion and wherein said transverse portion extends in opposite directions away from said longitudinal portion, said assembly including a semiconductive inner sleeve for surrounding said lugs and a substantially continuous outer jacket, and said assembly having an insulated portion separating said inner sleeve and said outer jacket and engaging said insulated portions of said adapters;

first removable conductor means extending along said transverse portion for engaging and rigidly fastening said lugs within said transverse portion, thereby to provide an electrically conductive circuit junction between said lugs; and second means including said first means and extending through said transverse portion to provide a rigid but removable interface for receiving a portion of an external utilization device adjacent said assembly.

2. The connector according to claim 1, wherein said second means receive first and second external utilization devices.

3. The connector according to claim 2, wherein at least one of said utilization devices is a test point plug having a metallic member embedded therein, thereby providing a test point capacitively coupled to said conductor portions of said cable ends.

4. The connector according to claim 1, wherein the longitudinal axis of said first section is laterally spaced from the longitudinal axis of said second portion in offset relationship therewith whereby tang portions of said lugs overlap one another.

5. The connector according to claim 1, wherein said first means comprises a threaded fastener.

* * * * *